US011822290B2

(12) United States Patent
Halter

(10) Patent No.: US 11,822,290 B2
(45) Date of Patent: Nov. 21, 2023

(54) TOURBILLON WITH TWO OSCILLATORS IN ONE SINGLE CAGE

(71) Applicant: Vianney Halter, Pontarlier (FR)

(72) Inventor: Vianney Halter, Pontarlier (FR)

(73) Assignee: Vianney Halter, Pontarlier (FR)

( * ) Notice: Subject to any disclaimer, the term of this patent is extended or adjusted under 35 U.S.C. 154(b) by 393 days.

(21) Appl. No.: 17/186,070

(22) Filed: Feb. 26, 2021

(65) Prior Publication Data

US 2021/0263472 A1 Aug. 26, 2021

(30) Foreign Application Priority Data

Feb. 26, 2020 (FR) ..... 20-01889

(51) Int. Cl.
*G04B 17/28* (2006.01)

(52) U.S. Cl.
CPC ..... *G04B 17/285* (2013.01)

(58) Field of Classification Search
CPC ..... G04B 17/285; G04B 15/14
See application file for complete search history.

(56) References Cited

U.S. PATENT DOCUMENTS 7,350,966 B2 * 4/2008 Zaugg ..... G04B 1/12 368/127
7,527,423 B2 * 5/2009 Ruchonnet ..... G04B 17/285 368/127
9,588,492 B2 * 3/2017 Roth ..... G04B 17/26
2008/0144447 A1 * 6/2008 Ruchonnet ..... G04B 17/285 368/127
2016/0231708 A1 * 8/2016 Roth ..... G04B 13/008

FOREIGN PATENT DOCUMENTS

WO WO-2018083586 A1 * 5/2018 ..... G04B 17/285

* cited by examiner

*Primary Examiner* — Edwin A. Leon
*Assistant Examiner* — Kevin Andrew Johnston
(74) *Attorney, Agent, or Firm* — Renner, Kenner; Zach J. Boehnlein

(57) ABSTRACT

A horological Tourbillon comprising A) a cage CC rotating around an axis (ZC), divided in two half-cages (1*a,b*) by a medial plane (RC) perpendicular to the rotation axis (ZC); a double tourbillon (TD) with two regulation systems each made of an oscillator (OSa,b), a lever and it's escapement mobile (MEa,b), installed in their respective half-cage (1*a,* 1*b*); the two regulation systems being made of identical elements but organized in an opposite configuration and installed in each half-cage (1*a,* 1*b*) symmetrically relatively to the medial plan (RC) so that, in the medial plane, the rotation direction of the two escapement mobiles (MEa,b) are identical; each regulation system has a compensating wheel (RFa,b) that meshes with its escapement mobile (MEa,b); B) a differential (D) made of: two outputs S (a,b) each meshing into a compensating wheel (RFa,b), thus creating a position compensation; one input pinion (ED) linked to the horological mechanism (MH); C) one linkage (EC) between the horological mechanism (MH) and the cage (CC) that allows the cage to rotate around its axis (ZC).

11 Claims, 13 Drawing Sheets

[Fig. 1]
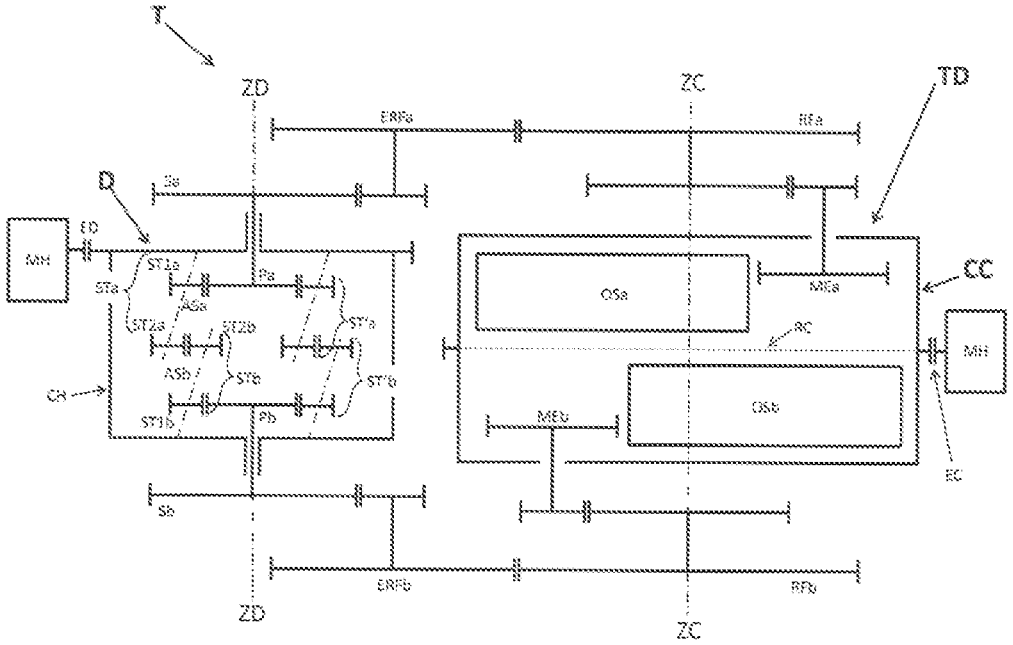

[Fig. 2]
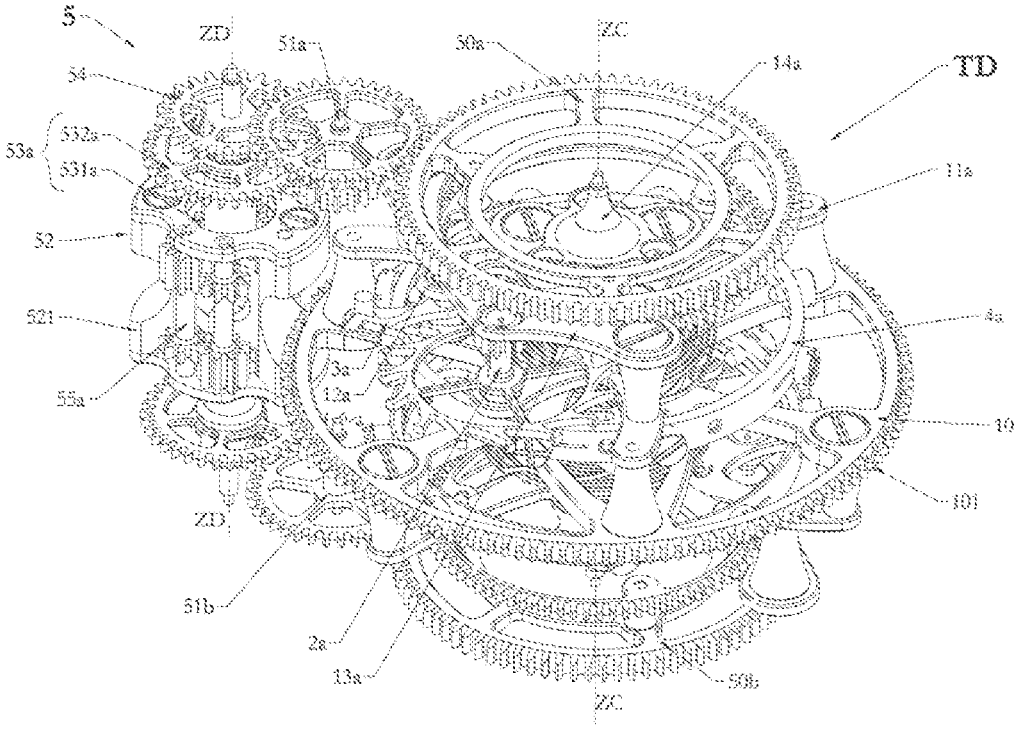

[Fig. 3]
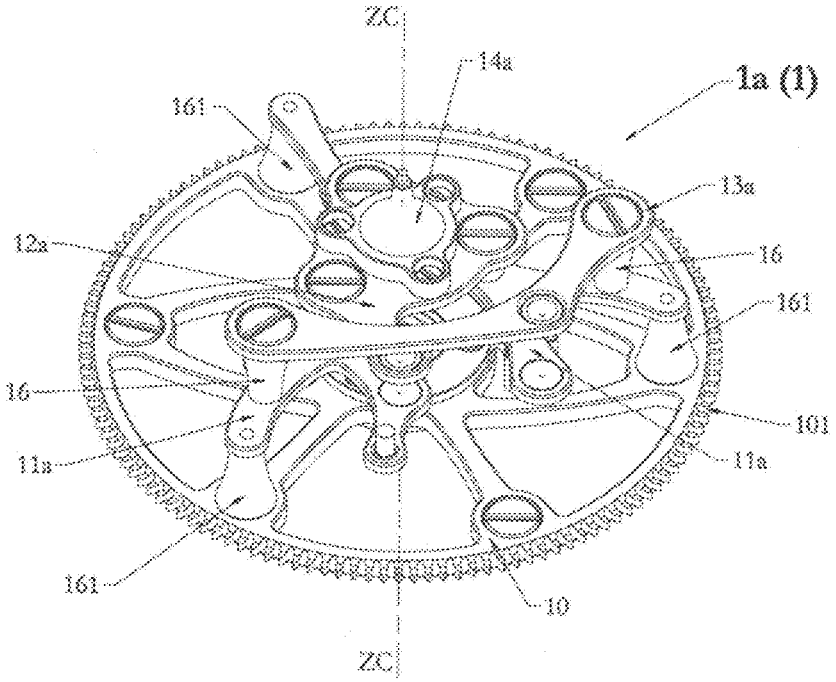

[Fig. 4]
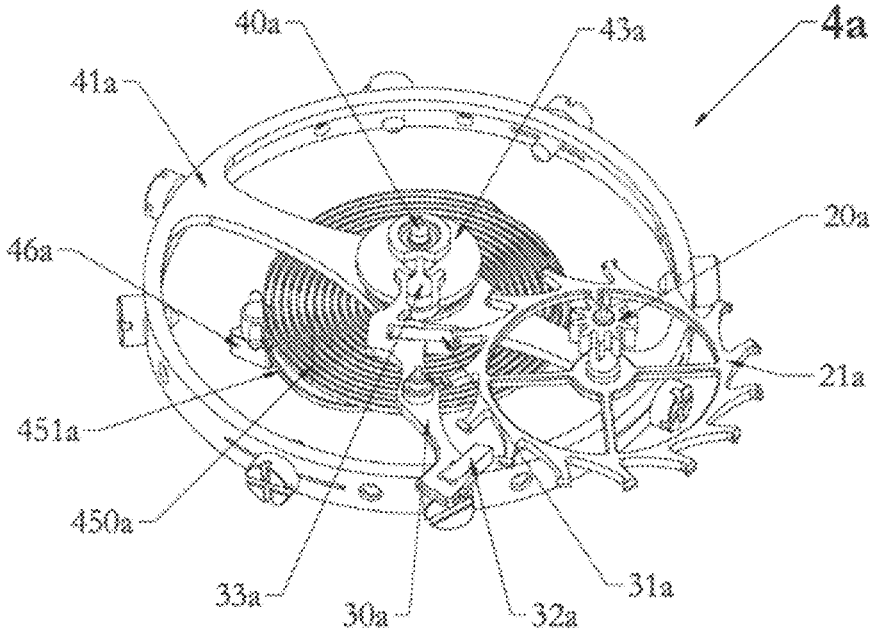

[Fig. 5]
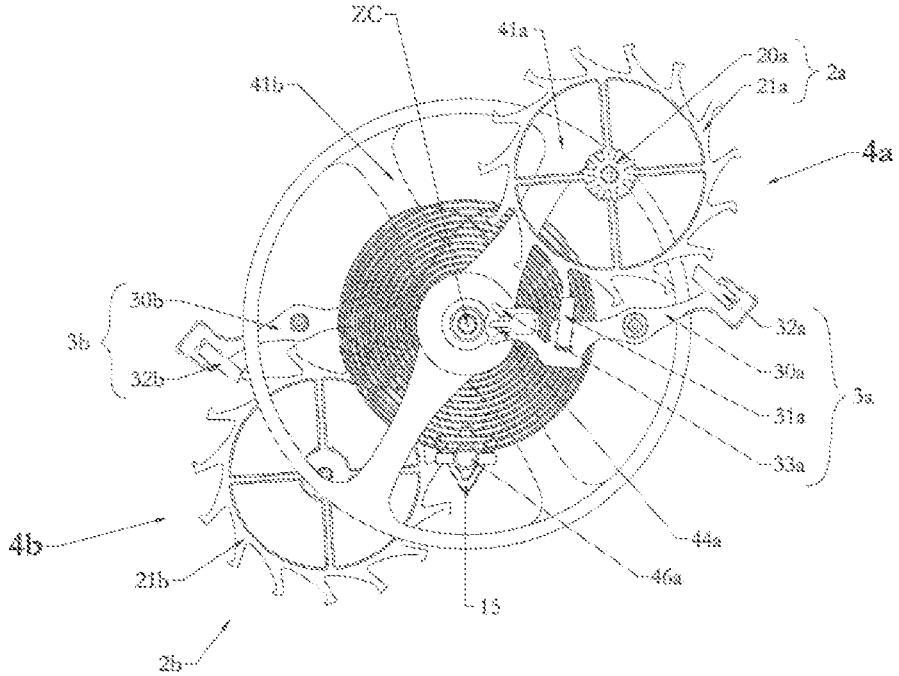

[Fig. 6]
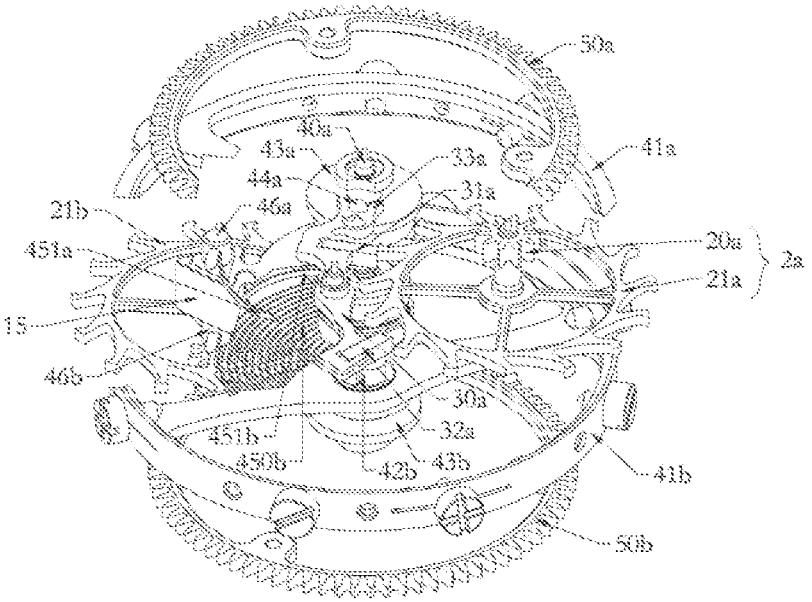

[Fig. 7]
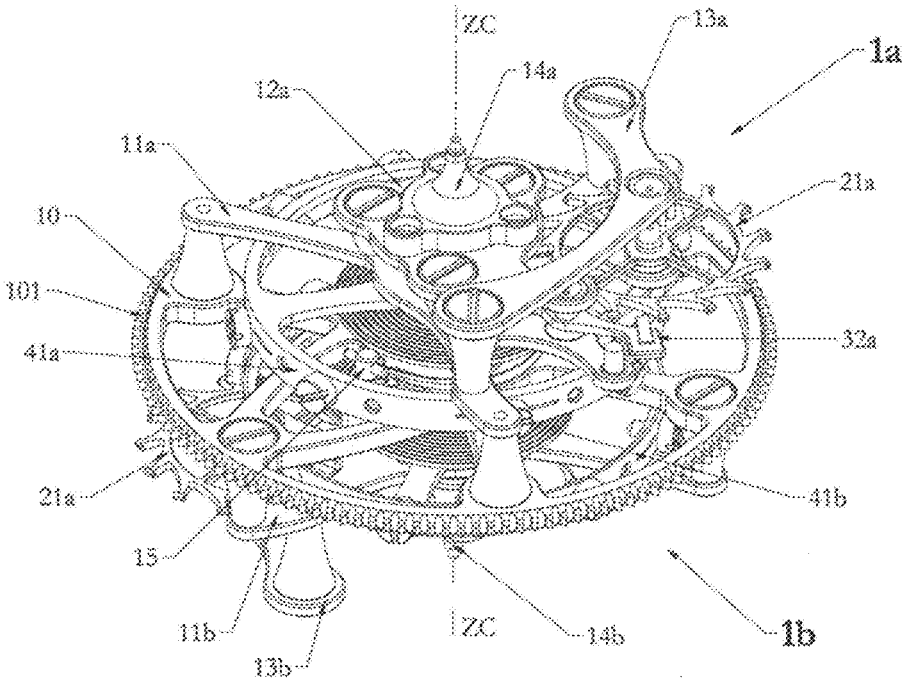

[Fig. 8]
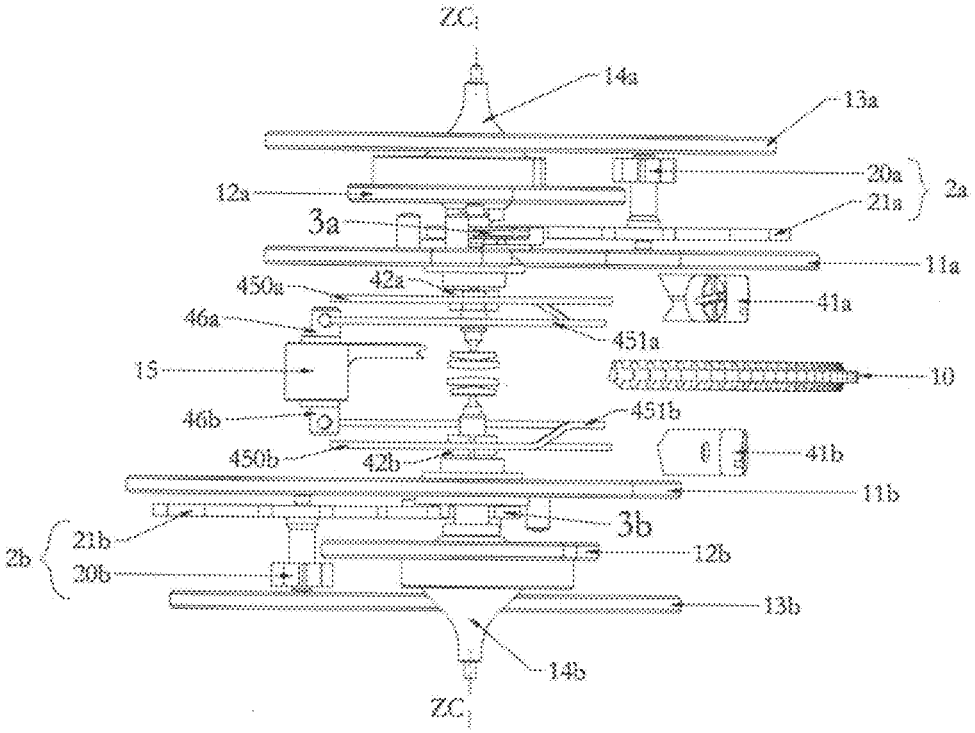

[Fig. 9]
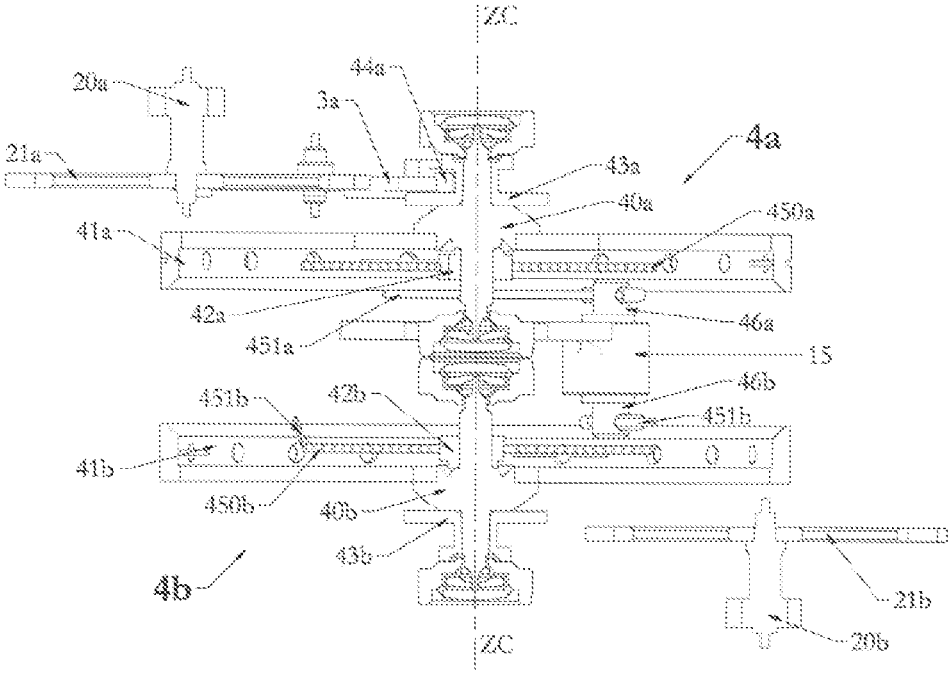

[Fig. 10]
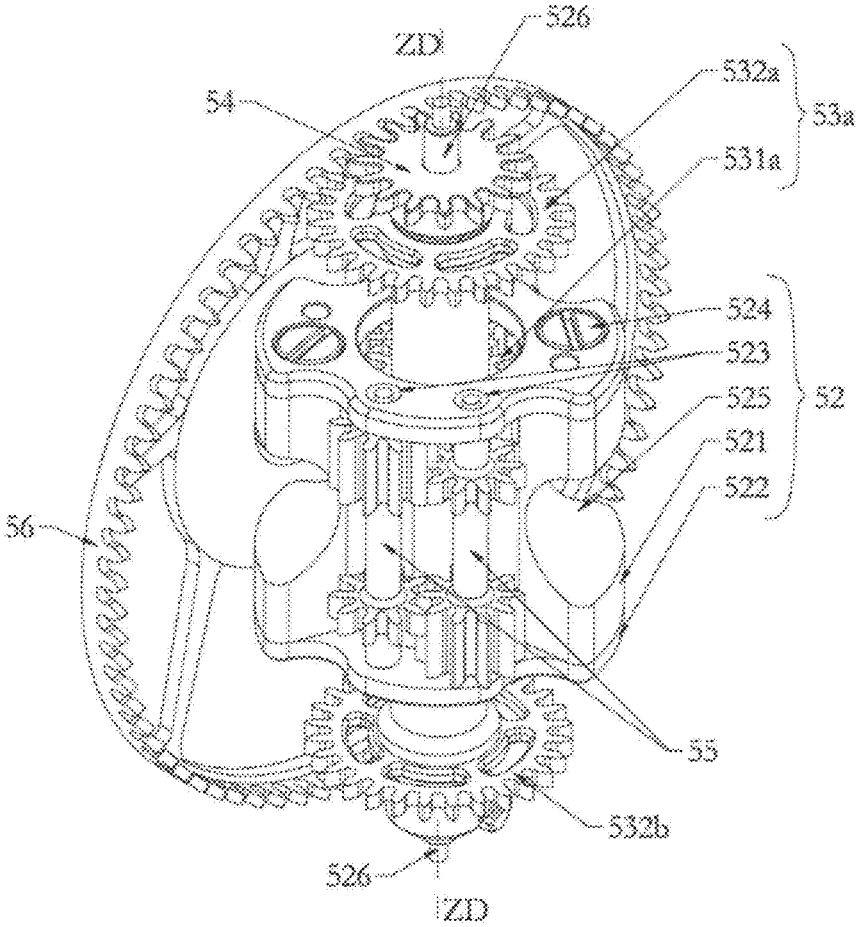

[Fig. 11]
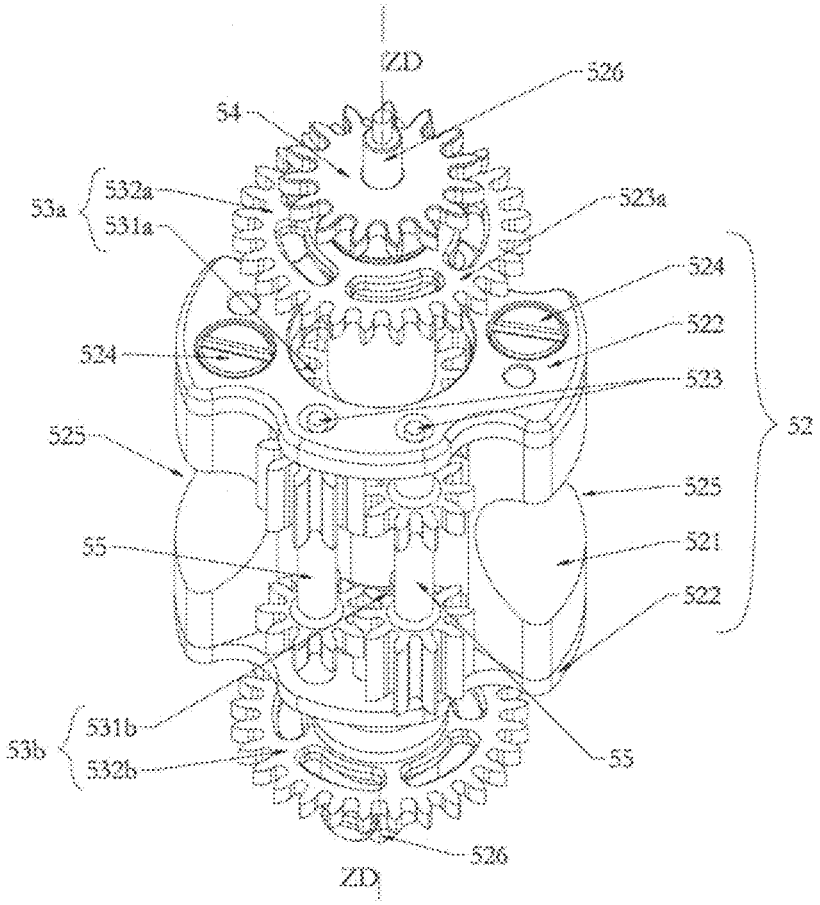

[Fig. 12]
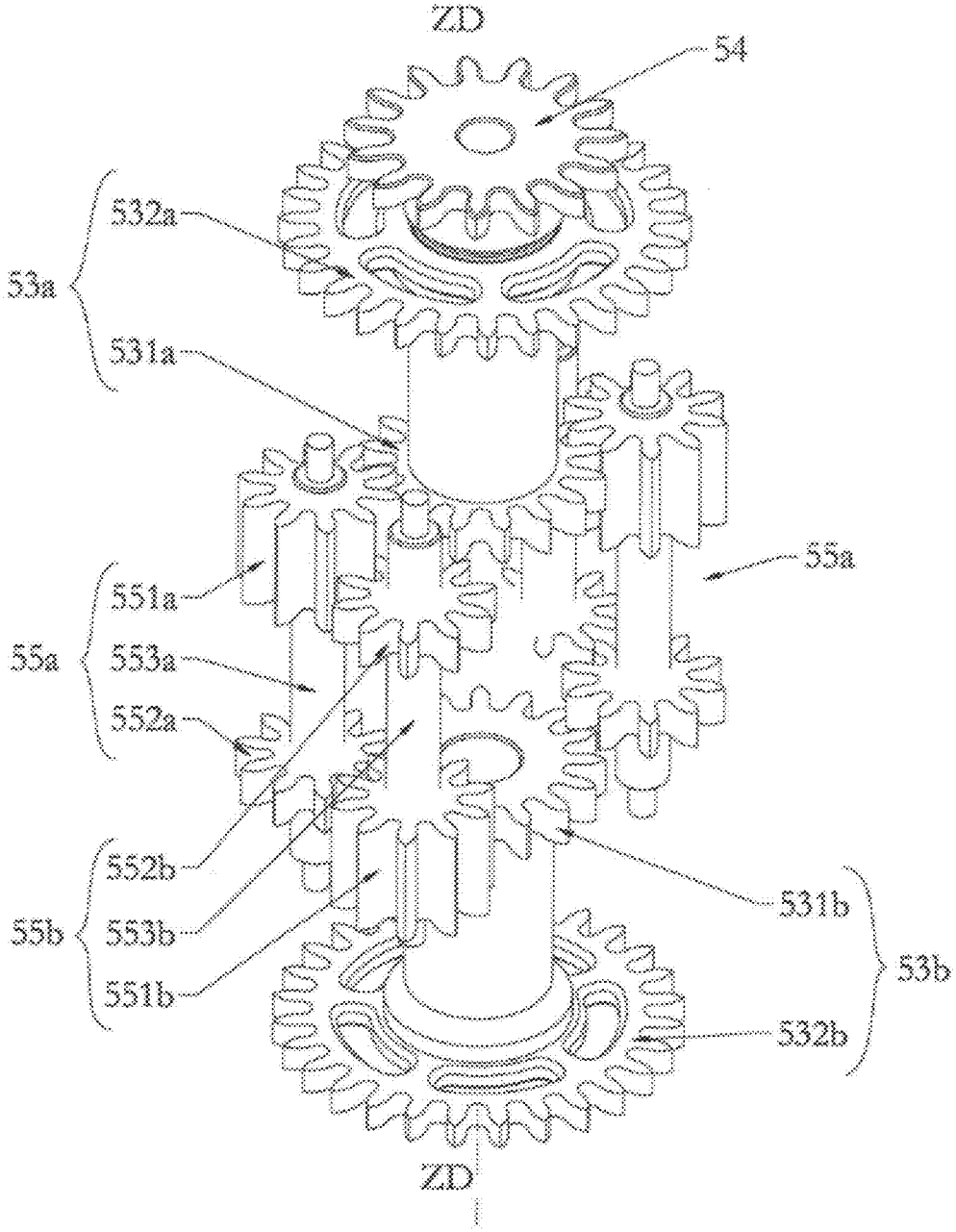

[Fig. 13]
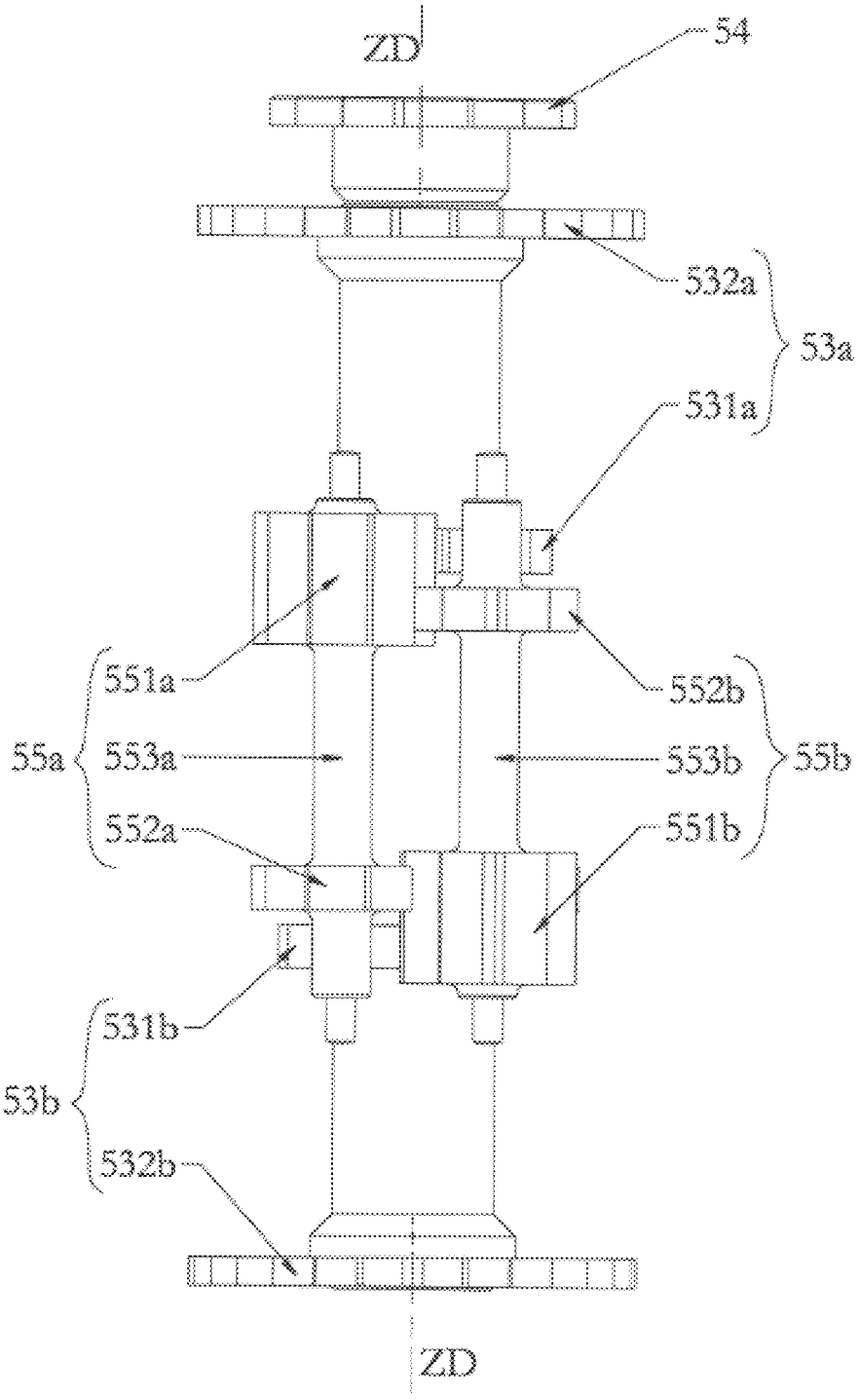

TOURBILLON WITH TWO OSCILLATORS IN ONE SINGLE CAGE

FIELD OF INVENTION

The invention object is a watchmaking tourbillon whose cage contains two oscillators.

STATE OF THE ART

The tourbillon mechanism was invented by Abraham Louis Breguet in 1810. In such a mechanism, the escapement and the balance-spiral are set in a rotational motion inside a cage. Initially, this mechanism aimed to even out the positions when the watch was worn vertically. This way the static and dynamic balance defects would be leveled. Practically, the chronometric results for a wristwatch fitted with a tourbillon are subpar and do not compensate for the excess works such a device requires. However, the horological tourbillon is a staple of watchmaking tradition and is visually fascinating.

The basic principle of a tourbillon is to fit an entire escapement and it's oscillator inside the fourth wheel. The escapement pinion rotates against a fixed wheel. At each impulsion, the escapement releases the fourth wheel that carries the cage and all the components held within. The inertia of the cage is of utmost importance: if it is too heavy, it's acceleration will be diminished and the impact when it stops will be too strong.

At each impulsion, the balance wheel receives a little bit of energy from the escapement, which then propels it alternatively clockwise and anticlockwise. However the cage rotation steps occur during the impulses and only in one direction.

The spiral-balance that is used as an oscillator is attached to the cage by a stud. The stud links the terminal curve of the spiral to the balance bridge.

During one impulsion, the cage and the balance wheel motions are in the same direction. The balances receives one impulsion from the lever and one impulsion from the cage through the terminal curve of the spiral.

During the next impulsion, the cage and balance wheel motions are in opposite direction. The balances receives one impulsion from the lever and one opposite impulsion from the cage through the terminal curve of the spiral.

As a result, with a conventional tourbillon configuration, half of the impulsions will lead to a higher-than-average amplitude, and the other half will lead to correspondingly diminished amplitude. The function is asymmetrical regarding the balance wheel zero position.

The influence of the cage, while being problematic, can be compensated by tweaking the components of the balance. However the influence of the balance movement on the cage dynamics is uncontrollable.

When the escapement sends an impulsion to the balance in the same direction as the cage motion, the cage is subject to an opposite reaction, which slows down the motion of the cage and minimizes the stop shock.

When the escapement sends an impulsion to the balance in the opposite direction to the cage motion, the cage is subject to an opposite reaction, which speeds up the motion of the cage and creates an excess stop shock.

From the escapement standpoint, the asymmetry between two alternations can be a problem during the balance wheel's free angle.

After an impulsion in the same direction as the cage, the terminal curve of the spiral creates a pressure effort on the cage. This effort is being transmitted on the escapement through the pressure of the escapement pinion on the fixed wheel, which is not problematic and enhances the drawing security.

The drawing effect is a safety function in the lever escapement. Using the angle formed by the lever pallets and the escape wheel teeth, the pressure from the escape wheel teeth draws the lever fork away from the balance axle in case of a shock. This security function minimizes the perturbation duration if the lever dart were to touch the small plate of the balance axle, and quickly brings back the lever stem in contact with the limiting pins.

After an impulsion in the opposite direction to the cage, the terminal curve of the spiral creates a traction effort on the cage. This traction effort goes against the pressure applied on the cage by the gear train, and tends to push the cage backwards. Therefore the pressure from the escapement pinion teeth on the fixed wheel teeth will diminish, which in turns diminishes the pressure from the escape wheel teeth on the lever pallets. The drawing effect is diminished.

As a result, in a conventional tourbillon cage with a spiral balance oscillator and an lever escapement, there are perturbations from the balance to the cage, and from the cage to the balance. Some strong perturbation risks also occur every other alternation because the drawing effect diminishes.

To this day, the closest execution that could correct these defects is the H2 resonance tourbillon from Beat Haldimann.

AIM OF THE INVENTION

This invention aims to develop a horological tourbillon device that could alleviate the usual tourbillon cage perturbations.

(Expose) And Advantages of the Invention

To achieve this the present invention encompasses a horological tourbillon comprising:

A) A cage, rotating around an axis, and divided into two half-cages across a medial, equatorial plane that is perpendicular to the rotation axis,
   - A double tourbillon, each enclosing a complete regulation system—each half-cage holding one spiral-balance oscillator, one lever and it's corresponding escapement mobile,
   - The two regulation systems being made of identical elements, but with an inversed configuration and installed in their respective half-cage symmetrically from one another regarding the medial plane. The whole configuration is designed to keep the rotation direction of both escape wheels identical,
   - Each regulation system being fed with a distinct compensation wheel, B) A differential comprising:
   - Two outputs each meshing into a compensation wheel, to create a position compensation,
   - One input that is fed by the rest of the movement main gear train, C) A dedicated gear train to bring power to the rotation cage and make it rotate around it's axis. Such device is a horological tourbillon made of two balances inside one rotating cage.

According to another characteristic, the oscillator's axis are colinear to a main axis, which is the cage axis, the oscillators (spiral-balances) and their constituting elements are identical or identical within one planar symmetry, the escapements for both oscillators are identical or identical within one planar symmetry.

According to the invention, this invention has two main advantages:

When the two balances are working, they both oscillate synchronously and in opposite directions. This way the sum of the rotational motion of both oscillators regarding to their rotation axis is always zero. The resulting torque applied by the balances on the cage is consequently zero.

If the two balances are coupled for synchronization, the perturbation applied to the balances by the cage is spread over the two balances. Each oscillator therefore is less perturbated than if it were alone.

According to another advantageous characteristic the two spirals and balance wheels are identical to guarantee that inertias are as close as possible.

According to another advantageous characteristic the spirals are located between the balances, to minimize the space between the spirals and increase system capacity.

According to another advantageous characteristic the spirals coiling has the same direction to allow synchronicity of the development of the spirals during their function.

According to another advantageous characteristic the two escapement assortments are identical within a planar symmetry, to make the balancing of the cage easier.

According to another characteristic the oscillators may have a spiral with flat terminal curve or a Breguet overcoil.

According to another characteristic the escapements are of any type (swiss lever, trigger escapement, etc.) as long as the two escapements are identical.

In other terms the two oscillators are mounted head-to-toe, one being on the top of the medial plane, the other being below.

The plane of one escapement is above the plane of the corresponding balance, and the plane of the other escapement is below the plane of the corresponding balance.

The two spirals are enclosed inside the volume being circumscribed by the two balance rims.

As previously indicated the escapement mobiles are placed according to an axial symmetry regarding to the cage main axis, the rotation axis of the escapement mobiles are parallel to the cage main axis and are diametrally opposed regarding this main axis, the lever axles are parallel to the cage main axis and are diametrally opposed regarding this main axis.

According to another characteristic the cage is made of a cage belt wheel that constitutes the medial plane with the two half-cages being on each side. Each half cage being made of plates and bridges.

The escapement pinions each sticking out of their respective half-cage to mesh with the corresponding compensation wheel which is aligned with the cage main axis, The cage belt wheel has a toothed belt to be set in motion by the movement gear train.

According to another characteristic the differential has flat gears comprising:

A frame holding it's rotation axis.

Two output wheels on this axis, linked together by at least one pair of satellites mounted in head-to-toe pairs, each satellite carrying two pinions mounted on the same satellite axis.

Two satellites in a pair meshing together by their homologous pinions, and each satellite meshing with their respective differential output via the other pinion.

According to another characteristic the main tourbillon axis and the differential axis are parallel.

The differential frame being made of a base carrying two colinear pivots, one of them carrying the input pinion. The frame carrying two plates with rotating points in which the satellites rotate.

According to another characteristic each satellite is made of one short pinion and one long pinion. The satellites in each pair are mounted head-to-toe, their rotation axis being parallel.

The satellite pairs being mounted in the differential following a 180 degrees symmetry according to the differential frame rotating axis, the long pinion of one satellite is cut so as to mesh with the tubular output pinion and with the short pinion of the other satellite in the same pair, the short pinion of each satellite is cut so as to mesh with the long pinion of the other satellite in the same pair, while avoiding to mesh with any output pinion.

In other terms the satellite pinion is made of:

One long pinion that can mesh with the output pinion and the short pinion from the other satellite.

One short pinion that only meshes with the long pinion of the other satellite from the same pair without meshing with the output pinion.

A part of the satellite axle that is grooved, so as to allow the cage belt wheel to pass, thus minimizing the encumbrance of the cage+differential system.

The satellite pinions work as a pair and one pair would be sufficient to create a differential. However according to the invention a couple of pairs is preferred to keep the gear pressure vector sum down to zero on the differential axis. This protects the differential pivoting points and does not create a preferred rotation direction.

According to another particularly advantageous characteristic the differential frame has an equatorial groove to allow the cage belt toothing to pass and thus reducing the encumbrance on the equatorial plane. All the differential satellites also exhibit a similar equatorial groove.

In other terms, to allow the reduction of distance between the differential axis and the tourbillon cage axis, the differential has a hourglass shape, so do the differential satellites.

As a result the horological tourbillon according to the invention is a particularly compact configuration that allows for a considerable enhancement of the mechanism regulation.

BRIEF DESCRIPTION OF THE FIGURES

The present invention will be described hereafter in a more detailed fashion using various realization modes shown in (annexed) schematics in which:

FIG. 1 general schematic of a horological tourbillon comprising two oscillators following the invention, FIG. 2 isometric perspective view of one realization mode comprising a device with two oscillators in one tourbillon cage and a differential feeding the two compensation wheels, FIG. 3 isometric perspective view of the bridgeworks of the top half-cage of the tourbillon, FIG. 4 isometric perspective view on one of the tourbillon's escapement and the corresponding escapement, FIG. 5 top view of the top and bottom regulatory systems showing the symmetry of the elements following the cage axis, FIG. 6 isometric perspective view of the tourbillon in FIG. 2, highlighting the elements of the escapement in the cage, FIG. 7 perspective view of the tourbillon according to the invention, FIG. 8 side view showing the structure of the complete cage, particularly the spirals, FIG. 9 cut view of the functional elements of the cage, FIG. 10 isometric perspective view of the differential and the wheel that meshes with the differential input pinion, FIG. 11 isometric perspective view of the differential without its frame, FIG. 12 simplified schematics of the differential, without its frame, FIG. 13 side view of the differential without its frame.

DESCRIPTION OF THE REALIZATION MODES

FIG. 1 is a general schematic of the horological tourbillon according to the invention, comprising a double tourbillon TD linked to the watch mechanism MH by a differential D. The differential's input pinion ED is linked to the watch mechanism MH and the differential's outputs Sa, Sb are linked to the two compensation wheels feeding the escapements of the double tourbillon TD.

According to the horological tradition the function of the mechanism will be described from the source of the power to the oscillator. As a result the description of the relationship with the differential D is the opposite of some terminologies regarding the differential outputs.

The speed of the horological mechanism MH is dictated by the regulation system made of the double tourbillon TD and it's two combined oscillators. The two oscillators have a frequency that is identical in theory, but necessarily different practically, which implies that this difference needs to be compensated to void the mechanism stoppage. The speed co dictated by the double tourbillon TD is the speed average between the speed $\omega_1=(\omega+\delta\omega)$ and $\omega_2=(\omega-\delta\omega)$ of respectively the two oscillators OSa,b since the differential frame will rotate at a speed $(\omega_1+\omega_2)/2=\omega$.

The horological tourbillon T according to the invention comprises the double tourbillon TD itself made of a cage CC rotating around the axis ZG, and led by the horological mechanism MH by a gear train linked to the cage belt wheel EC of the cage CC.

The cage belt wheel RC defines the cage medial plane CC. On each side of this plane is installed an oscillator OSa, OSb, respectively. These oscillators are constructed and regulated so that their frequencies are as close as possible to each other, However the two oscillators frequencies can never be completely identical.

This slight discrepancy around the average frequency is taken into account by the differential. We will name $\omega_1=(\omega+\delta\omega)$ the speed of one of the oscillators, and $\omega_2=(\omega-\delta\omega)$ the speed of the other. This frequency difference is being translated by a shift in the speed of the compensation wheels, which in turn affect the speed of the differential outputs.

The average of those two speeds is necessarily the speed co dictated by the regulation system to the horological mechanism MH.

Each oscillator OSa, OSb is fed by an escapement mobile MEa,b carried by the cage CC, itself being fed by the compensation wheel RFa, RFb, each being linked to one of the two differential D outputs through an intermediate wheel ERFa, ERFb, respectively.

The gearing between an escapement mobile Mea,b and the corresponding compensation wheel RFa,b is not detailed, given that this structure clearly appears in FIG. 1.

In order to simplify the drawing, the escapement mobiles MEa and MEb do not enter in the cage CC alongside the axis ZC, but are rather shown on the sides of the cage CC. The compensation wheels RFa, RFb are coaxial to the CC cage axis ZC. This does not modify the linkage between the escapement mobiles MEa, MEb to their corresponding compensation wheel RFa, RFb.

The differential D is composed of a frame CH set in motion around it's axis ZD, and carry the output mobiles Sa, Sb each carrying an output pinion Pa, Pb coaxially to ZD. The two output pinions Pa, Pb are linked by two satellites STa, STb carried by the differential frame CH. The satellites reverse the rotation motion of the two pinions Pa, Pb according to the conventional function of a differential.

In the case of the schematics in FIG. 1, the differential D has gearings that are flat, not conical. The traditional conical satellite role is replaced by a pair of flat satellite gears that reverse the motion.

Each satellite STa, STb is made of two pinions (ST1*a* long, ST2*a* short) and (ST1*a* long, ST2*a* short) each on a single axis ASa, ASb carried by the frame CH.

- the long pinions ST1*a*, ST1*b* respectively mesh with the corresponding output pinion Pa, Pb,
- the short pinions ST2*a*, ST2*b* respectively mesh with the opposite satellite long pinion ST1*b*, ST1*a*.

The number of teeth for the pinions ST1*a* . . . ST2*b* being the same, the combination of the two satellites STa and STb reverses the transmitted motion from one satellite to the other. As a result when the frame CH rotates with speed co the outputs rotate at a speed $+/-\delta\omega$ relatively to the frame.

The outputs Sa, Sb receive the motion $\omega_1$, $\omega_2$ from the two oscillators and convey them to the two pinions Pa, Pb; because each pair of satellites is carried by the frame CH, the frame is set in rotation around the axis ZD at the average speed $\omega=(\omega_1+\omega_2)/2$. The relative differences in rotation speed $+\delta\omega$ and $-\delta\omega$ from the two pinions Pa, Pb ends up being compensated.

The horological tourbillon TD dictates its rotation speed co to the rest of the mechanism MH.

For the sake of clarity of FIG. 1, the representation of the axes ASa and ASb are tilted to show the angular shift of the two satellites Sa, Sb around the axis ZD in the frame CH. In reality one of the satellite STa is in front the plane of FIG. 1, and the satellite ST bis behind this plane.

In order to equally transmit the pressure efforts to the output pinions Pa, Pb, the satellite pair STa, STb is supplemented by a second identical pair ST'a, ST'b, symmetrically placed according to the axis ZD.

FIGS. 2 and 3 show a mode of realization of the tourbillon T whose detailed components are differentiated in the figures by numerical references. As a reminder, general references from FIG. 1 will be added.

To simplify the representation of the horological tourbillon T, given the identity of shapes and symmetries, the components will bear their numerical references appended by the suffix (a) or (b).

FIG. 2 shows an isometric perspective ensemble view of one mode of realization of the horological tourbillon, comprising a double tourbillon TD linked to the horological mechanism by a differential 5.

The different parts of the double tourbillon TD will be described separately in FIGS. 3-13.

FIG. 3 shows the bridgeworks of a half-cage carried by the cage wheel 10, shared by the two half-cages 1*a*, 1*b* and defining the medial plane RC of the cage 1, perpendicular to the cage rotation axis ZC.

The wheel 10 has a belt toothing 101 for its gearing. It carries the escapement plate 11*a* using the pillars 161. The escapement plate 11*a* carries the escapement bridge 13*a*.

The lever bridge 12*a* is carried by the escapement plate 11*a* and the cage pivot 14*a* is mounted on the lever bridge 12*a*.

The cage elements are mounted in a rigid way. The escapement plates 11*a,b* are carried by the shared wheel 10 via pillars 16. The lever and escapement bridges (respectively 12*a,b* and 13*a,b*) are mounted on the escapement plate 11*a,b* via pillars 16. The cage pivots 14*a,b* are mounted on the lever bridges 12*a,b*.

The bridgework shown on FIG. 3 is reused symmetrically according to the previously mentioned situation, and receives the components of the second oscillator OSb.

FIG. 4 shows the oscillator 4*a* which is on top according to the representation position. It is installed in it's half-cage shown on FIG. 3. Separately, this oscillator 4*a* displays the usual structure of an oscillator: a balance wheel 41*a*, mounted on an axis 40*a* which conical part carries a double plateau 43*a* fitted with an ellipsis 44*a*.

A collet 42*a* carrying a spiral 45*a* is fitted on the cylindrical portion of the axis 40*a*. The spiral 45*a* comprises an Archimedean flat spiral portion 450*a* and a Breguet overcoil 451*a*. The terminal curve is attached to a stud 46*a* held in a stud holder 15, linked to the cage wheel structure 10 (FIGS. 5 and 6).

The lever 3*a* is made of a base 30*a*, an entry pallet 31*a* and exit pallet 32*a*. It ends by the fork 33*a* working with the ellipsis 44*a* from the oscillator 4*a*.

FIG. 5 is a planar view of the combination of the two oscillators 4*a*, 4*b* (as is oscillator 4*a* in FIG. 4) on the same axis ZC (FIG. 1) on their respective sides of the plane defined by the shared, unshown, cage wheel 10. The two oscillators 4*a*, 4*b* are diametrically opposite and rotate in the same direction, as can be deducted simply by looking at the teeth of the escape wheels 21*a*, 21*b*.

Geometrically, in this configuration, the escapements must be identical by a mirror reflection. The functions of the swiss lever escapement is well known and will not be further described here.

The oscillators 4*a*, 4*b* are necessarily identical, and are assembled in head-to-toe configuration. Their components (collet 44*a,b* and spiral 45*a,b*) are also geometrically identical and assembled the same way. When observed along the cage axis 5 they appear to be identical according to a planar symmetry. Their motions are most of the time synchronous and opposite from each other. The rest of the time, they exist in a wide range of transient behaviors during which the frequencies are in the process of balancing each other out—i.e. the motions are not completely synchronous.

In order to balance the cage, the axes of the two escapement mobiles 2*a*, 2*b* are parallel to the cage axis ZC and placed in diametral opposition relatively to that axis. So are the axes of the two levers 3*a*, 3*b*. This placement can be seen in FIG. 5.

The escapement mobiles 2*a,b* are made of the escapement pinions 20*a,b* and escapement wheels 21*a,b*. Each pinion 20*a,b* rotates around a compensation wheel 50*a,b*. In order to keep the system functioning during asynchronous periods, the two compensation wheels are linked to the differential via transmission mobiles.

FIG. 6 is a perspective view of the elements in FIG. 5 supplemented by to the two compensation wheels 50*a,b* and their relationship with the escapement pinions. One can infer the meshing of the wheels 50*a* with the escapement p inion 20*a*. Only the levels of the compensation wheels 50*a*, 50*b* has been represented. The meshing with the transmission mobiles has been omitted.

FIG. 7 shows the combination of the two oscillators 4*a*, 4*b* inside the bridgeworks shown in FIG. 3, completed by the other homologous bridgework under the cage wheel 10. This constitutes the cage 1 of the tourbillon TD.

The representation is limited to the bridgeworks on the double cage 1*a*, 1*b*, the escapements (escapement mobiles 2*a,b*, levers 3*a,b*), the oscillators 4*a,b*. The cage 1 is set in motion by the cage belt gearing 101.

The fixed elements of the cage 1 are a cage wheel 10, shared by the two half-cages 1*a*, 1*b* as their base. The escapement plates 11*a,b* carry the levers 3*a,b* and the escapement mobiles 2*a,b*. The lever 3*a,b* is positioned by the lever bridge 12*a,b*, which also holds the oscillators 4*a,b*. The escapement bridge 13*a,b* holds the escapement mobiles 2*a,b*.

The cage 1 is held in position by it's pivots 14*a,b* (FIG. 3).

The layered organization of the cage 1 is highlighted in the sideview in FIG. 8 and the side cut view in FIG. 9 showing the symmetrical disposition of the components relatively to the rotation axis ZC, as well as the two studs 46*a*, 46*b* on the shared, double stud holder 15.

The differential 5, shown in FIGS. 1 and 11 is made of a frame 52, itself made of a base 521 in which are fitted two pivots 526. Two plates 522 carrying the pivoting points 523 of the satellites 55 are attached to the base 521 by two screws 524 each. The pivots 526 define the differential rotation axis ZD and are used as rotation axles for the two output mobiles 53*a,b*. The base 521 has two lateral grooves 525 to allow the differential to be mounted closer to the cage TD and let the cage gear 10 pass inside the differential inscribed volume, so that the differential frame 52 and the cage 1 can rotate freely around their axis respectively ZD, ZC.

The frame 52 carries the input pinion 54 that is led by the wheel 56, itself linked to the horological mechanism MH.

The output mobiles 53*a,b* are each made of a tubular pinion 531, and an output wheel 532 pressed on the pinion.

The satellites 55 are assembled in pairs, positioned head-to-toe, and the pairs are installed in the frame 52 in diametral opposition relatively to the axis ZD.

The four satellites 55 are identical.

According to the references in FIG. 11, a satellite 55 is made of a long pinion 551, a short pinion 552, and a axle 553. The two pinions 551 and 552 are flat pinions, with gearing in a plane which is perpendicular to their rotation axis. Their lengths are different so they can be combined and accomplish the inverting function. The satellites mesh with the output pinions 531 as shown in FIGS. 12 and 13.

According the FIGS. 12 and 13, the satellites 55*a* and 55*b* in one pair are installed head-to-toe and:

the satellite 55*a* meshes:

by the long pinion 551*a* with the output pinion 531*a* by the long pinion 551*a* with the short pinion 552*b* by the short pinion 552*a* with the long pinion 551*b* the satellite 55*b* meshes:

by the long pinion 551*b* with the output pinion 531*b* by the long pinion 551*b* with the short pinion 552*a* by the short pinion 552*b* with the long pinion 551*a*

The axis of the satellites must be located on a cylinder whose central axis is ZD so that the long pinions 551*a,b* mesh with their respective output pinions 531*a,b*. Also each long pinion 551 has to mesh with the output pinion 531, and the output pinion 531 must not interact with the short pinion 552. The short pinion must therefore stay over/under the output pinion 531 as shown in FIG. 13.

The possibilities of meshing two gearings at a time between 531, 551, 552, is made possible by the asymmetry in the satellite pinion sizes.

The axes 553*a,b* of the satellites 55*a,b* are diametrically opposite relatively to ZD, on a circle centered on this axis. The minimum diameter at the waist of the differential D is defined by this circle, thus the grooves 525 in the frame 52 are deep enough that the frame diameter at this point does not exceed the circle.

The diametrically opposite configuration of the satellite pairs and the transverse orientation of the frame 52 create a cross pattern that is balanced around the axis ZD. This cross disposition is shown in FIGS. 1, 12 and 13.

The FIG. 12 indicates the rotation of the differential's 5 elements:

The output mobiles 53*a,b* have a speed of $\omega_1=(\omega+\delta\omega)$ and $\omega_2=(\omega-\delta\omega)$ around the axis ZD. These speeds are respectively superior and inferior than the average speed $\omega=(\omega_1+\omega_2)/2$ according to the function of a differential.

To conclude and sum it up, one needs to notice that the structure of the differential of the realization in FIG. 2 differs from the one in FIG. 1. The FIG. 1 being flat schematics it is impossible to display the axially compact organization of the differential D.

In this mode of realization the frame 52 passes through the output mobiles 53*a,b* along the axis ZD, and receives the input pinion 54 over one of the two output mobiles.

Going back to the full view in FIG. 2 and the flat schematics of FIG. 1, the differential 5(D) is made of the frame 52(CH) rotating around the axis ZD. Carried by the frame 52(CH) are two output mobiles 53*a,b* (Sa,b) rotating around the axis ZD. The two output pinions of the output mobiles 53*a,b* have the same number of teeth, which must be even. The output mobiles 53*a,b* mesh with the transmission mobiles 51*a,b*(ERFa,b).

The differential functions with flat gearing and comprises:

a frame CH/52 rotating around the axis ZD two output mobiles Sa, Sb along the axis ZD, linked together by at least one pair of satellites STa,b: ST'a,b mounted head-to-toe, each satellite having two pinions ST1*a*, ST1*b*; ST2*a*, ST2*b* carried by the same axle.

Two satellites STa,b; ST'a,b meshing together

By two homologous pinions ST2*a,b*; ST'2*a,b* and

By the other pinion ST1*a*, ST1*b*; ST'1*a*, ST'1*b* one and the other with an output mobile Sa, b The satellites 55*a,b* (STa,b) are used as inverting links for the two output mobiles 53*a,b* (Sa,b). The inverters operate in pairs to cancel the resulting pressure on the gearing. The four satellites 55 (STa, STb, ST'a, ST'b) have the same number of teeth. The rotation axes of the satellites 55 (STa,b) are parallel to the rotation axis ZD of the differential 5(D) frame 52 (CH). The axes of the satellite 55 (STa,b) pairs are set in diametral opposition relatively to the axis ZD.

The satellites 55*a,b* (STa,b) mesh simultaneously with their output mobiles 53*a,b* (Sa,b). As a consequence of the equal number of teeth, the two output pinions 532*a,b* (Sa,b) rotate at the same speeds in opposite directions, when considered in the differential frame referential.

Following the same reasoning, in a referential that is exterior to the differential, the rotation speed of the differential frame 52 (CH) is equal to the averaged speed between the two output pinions 532*a,b* (Sa,b) rotation speeds.

This layered differential 5 (D), uses flat gearings 53*a,b*, 55*a,b* (Pa,b, STa,b, 5*a,b*) to replicate the behavior of a conical gearing differential. Although more complex by having more elements, this configuration allows the usage of flat gearing norms (NIHS 20-25 for example) instead of less efficient and more complicated to machine conical gearing. Moreover the pivoting is more efficient due to having a rotation between two pivots.

The two output pinions 531 of the differential 5 are attached to the output wheels 532 (Sa,b), meshing with the transmission mobiles 51*a,b* (ERFa,b), themselves meshing with the compensation wheels.

In this likening of the FIG. 1 schematics and the FIG. 2 isometric perspective of a realization mode, the double tourbillon TD is shown first by it's cage 1 (CC) with cage wheel 10 (RC), split in two half-cages 1*a,b*. In each half-cage 1*a,b* sits one oscillator 4*a,b*, it's lever 3*a,b* (OSa,b) as well as the escapement mobile 2*a,b* (MEa,b). The belt wheel gearing 101 of the cage wheel 10 acts as the entry point EC set in motion by the horological mechanism MH.

In a traditional tourbillon configuration, the fixed wheel is used as a circle on which the escape pinion rolls, which then transforms the cage rotation into a satellite motion around the fixed wheel.

In the configuration described according to the invention, the cage 1 (CC) itself was slowed down and the remainder of the necessary motion was brought by the compensation wheel 50 (RF), thus replacing the fixed wheel. As a consequence, the compensated wheel is always pressing against the escapement pinion 20 (ME), which allows the introduction of a differential 5 (D) to take into account the discrepancies in regulation between the two compensated wheels 50*a,b* (RFa,b).

The differential 5 (D) is set in motion by the rest of the movement (not shown) through it's input pinion 54 (ED) and it's frame 52 (CH).

NOMENCLATURE OF THE MAIN ELEMENTS

T Horological Tourbillon
TD Double Tourbillon
CC Tourbillon Cage
ZC Axis of the Double Tourbillon
RC Cage Wheel, defining the medial plane
OSa,b Oscillator
Mea,b Escapement Mobile
EC Cage Input
RFa,b Compensation Wheel
D Differential
ED Differential Input
ZD Differential Axis
CH Differential Frame
Sa,b Differential Outputs
Pa,b Differential Output Pinions
STa,b; ST'a,b Satellites
ST1*a,b* Long Satellite Pinion
ST2*a,b* Short Satellite Pinion
ERFa,b Transmission Mobile
MH Rest of the Horological Mechanism
Cage
1*a*, 1*b* Half Cage
10 Cage Wheel
101 Cage Wheel Belt Gearing
102 Cage Bridge
11 Escapement Plate
12 Lever Bridge
13 Escapement Bridge

14 Cage Pivot
15 Shared Stud Holder
16 Pillar
161 Plate Bridge Pillar
2 Escapement Mobile
20 Escapement Pinion
21 Escapement Wheel
3 Lever (Complete)
30 Lever
31 Entry Pallet
32 Exit Pallet
33 Fork
4 Oscillator
40 Balance Axle
41 Balance Wheel Rim
42 Collet
43 Double Plateau
44 Ellipsis
45 Spiral Hairspring
450 Archimedean Spiral
451 Terminal Curve
46 Stud
5 Differential
50 Compensation Wheel
51 Transmission Mobile
52 Differential Frame
521 Frame Base
522 Frame Plates
523 Satellites Pivoting Points
524 Screws
525 Side Grooves
526 Differential Pivots
53 Differential Exit Mobile
531 Exit Mobile Tubular Pinion
532 Exit Mobile Wheel
54 Differential Input Pinion
55 Satellite
551 Satellite Long Pinion
552 Satellite Short Pinion
553 Naked Axle
56 Differential Feeder Wheel In order to simplify the presentation of the claims, every similar references are not systematically retranscripted in the claims. They only are when it is necessary for the understanding.

The invention claimed is:

1. A horological tourbillon comprising:

A) a cage rotating around an axis, divided in two half-cages by a medial plane perpendicular to the rotation axis;

a double tourbillon with two regulation systems each made of an oscillator, a lever and an escapement mobile, installed in their respective half-cage;

the two regulation systems being identical but organized in an opposite configuration and installed in each half-cage symmetrically relative to the medial plane so that, in the medial plane, the rotation direction of the two escapement mobiles are identical;

each regulation system has a compensating wheel that meshes with the corresponding escapement mobile;

B) a differential made of:

two outputs each meshing into the compensating wheel, thus creating a position compensation;

one input pinion linked to a horological mechanism;

C) one linkage between the horological mechanism and the cage that allows the cage to rotate around the axis of the cage.

2. The horological tourbillon according to the claim 1, characterized in a way so that:

axes of the oscillators are superimposed on one principal axis which is the axis of the cage;

the oscillators and their constitutive elements are identical or identical within a planar symmetry;

the escapement mobiles and the levers of the two oscillators are identical, or identical within a planar symmetry.

3. The horological tourbillon according to the claim 1, characterized in a way so that:

the oscillators are fitted with a flat spiral hairspring or a Breguet spiral hairspring.

4. The horological tourbillon according to the claim 1, characterized in a way so that:

the two oscillators are installed head-to-toe, one oscillator being above the medial plane and the other being below;

the plane of the corresponding escapement mobile and lever sits above the plane of the corresponding balance, and the plane of the other escapement sits below the plane of the corresponding balance, and both spiral hairsprings are contained in the space circumscribed by balance rims.

5. The horological tourbillon according to the claim 1, characterized in a way so that:

the escapement components are installed according to an axial symmetry around the cage axis;

pivoting axes of the escapement mobiles are parallel to the cage axis and diametrically opposed relatively to the cage axis; the pivoting axes of the levers are parallel to the cage axis and diametrically opposed relatively to the cage axis.

6. The horological tourbillon according to the claim 1, characterized in a way so that:

the cage is made of a cage wheel being the medial plane with a half-cage on each side of this plane, each half-cage being made of plates and bridges, each escapement mobile protruding from their half-cages to they can mesh with the corresponding compensation wheel, which is aligned with the cage axis, and the cage wheel has a wheel belt gearing so it can be set in motion by the horological mechanism.

7. The horological tourbillon according to the claim 6, characterized in a way so that:

the differential is a differential with flat gearing made of:

a frame that rotates around an axis, two output mobiles rotating around and linked together by at least one pair of satellites installed head-to-toe, each satellite having two pinions carried by one single axle, the two satellites in a pair meshing together via homologous ones of the pinions, and via another of the pinions, one and the other meshing with the output mobile.

8. The horological tourbillon according to the claim 1, characterized in a way so that:

the double tourbillon also having the axis of the cage, where the axis of the double tourbillon and the axis of the differential are parallel.

9. The horological tourbillon according to the claim 7, characterized in a way so that:

the frame of the differential comprises a frame base carrying two pivots aligned on its axis, one of these pivots being fitted with the input pinion, the frame base carries two plates, each having four pivoting points in which the satellites are installed.

10. The horological tourbillon according to the claim 7, characterized in a way so that:

each satellite is made of a long pinion and one short pinion, the satellites in each satellite pair being combined head-to-toe with parallel axes, the satellite pairs being installed following a 180° axial symmetry around the differential axis, the long pinion of one satellite is cut so that it can mesh simultaneously with the output pinion of the output mobile and the short pinion of the other satellite of this satellite pair, the long pinion of each satellite pair meshing on a fraction of its length with the output pinion of the output mobile and on another fraction of its length with the short pinion of the other satellite in the same pair, this is made so that no output pinion meshes with a short pinion.

11. The horological tourbillon according to the claim 9, characterized in a way so that:

the base of the frame of the differential has side grooves on its equator so the cage wheel belt gearing of the cage wheel can pass, it helps reducing the encumbrance on the equatorial plane, as all the satellites of the differential have a naked axle portion on their lengths to minimize the distance between the axis of the tourbillon and the axis of the differential.

* * * * *